United States Patent [19]

Metro et al.

[11] 4,440,657

[45] Apr. 3, 1984

[54] SYNTHETIC ESTER LUBRICATING OIL COMPOSITION CONTAINING PARTICULAR T-BUTYLPHENYL SUBSTITUTED PHOSPHATES AND STABILIZED HYDROLYTICALLY WITH PARTICULAR LONG CHAIN ALKYL AMINES

[75] Inventors: Stephen J. Metro, Scotch Plains; Dale D. Carr, Morristown, both of N.J.

[73] Assignee: Exxon Research and Engineering Co., Florham Park, N.J.

[21] Appl. No.: 413,894

[22] Filed: Sep. 1, 1982

[51] Int. Cl.[3] ..... C10M 3/40

[52] U.S. Cl. ..... 252/49.9; 252/565

[58] Field of Search ..... 252/565, 49.9

[56] References Cited

U.S. PATENT DOCUMENTS

| | | | |
|---|---|---|---|
| 2,758,086 | 8/1956 | Stuart et al. | 252/49.9 X |
| 2,938,871 | 5/1960 | Matuszak et al. | 252/49.9 |
| 3,468,802 | 9/1969 | Nail | 252/78 |
| 3,553,131 | 1/1971 | Hepplewhite et al. | 252/49.9 X |
| 3,701,730 | 10/1972 | Daniels et al. | 252/49.9 |
| 3,780,145 | 12/1973 | Malee | 260/966 |
| 3,790,478 | 2/1974 | Rudston et al. | 252/49.9 X |
| 3,790,481 | 2/1974 | Byford et al. | 252/49.9 |
| 3,914,179 | 10/1975 | Byford et al. | 252/32.5 |
| 3,931,023 | 1/1976 | Dounchis | 252/49.8 |
| 4,064,059 | 12/1977 | Nebzydoski et al. | 252/49.9 |
| 4,087,386 | 5/1978 | Dounchis | 252/49.8 |
| 4,141,845 | 2/1979 | Yaffe | 252/46.7 |
| 4,179,386 | 12/1979 | Reinhard et al. | 252/46.6 |

OTHER PUBLICATIONS

WADC Technical Report 59-379, E. N. Cart, Jr., "Improvement of Storage Life of MIL-L-7808 Oils", Jan., 1959.

*Primary Examiner*—Andrew Metz

*Attorney, Agent, or Firm*—Eugene Zagarella

[57] ABSTRACT

A synthetic ester lubricating oil composition having effective high temperature properties and hydrolytic stability comprising a selected synthetic ester base oil and the additive combination of a selected tertiary-butylphenyl substituted phosphate ester and a selected alkyl amine. Additionally, a method for providing hydrolytically stable turbine oils which comprises adding a combination of a selected tertiary-butylphenyl phosphate and a selected alkyl amine to a synthetic ester base oil.

12 Claims, No Drawings

SYNTHETIC ESTER LUBRICATING OIL COMPOSITION CONTAINING PARTICULAR T-BUTYLPHENYL SUBSTITUTED PHOSPHATES AND STABILIZED HYDROLYTICALLY WITH PARTICULAR LONG CHAIN ALKYL AMINES

BACKGROUND OF THE INVENTION

This invention relates to a synthetic ester lubricating oil composition having suitable high temperature properties and hydrolytic stability and to a method for providing hydrolytically stable turbine oils. More particularly, this invention is directed to a synthetic ester lubricating oil composition containing an additive package comprising the combination of a selected tertiarybutylphenyl phosphate and a selected alkyl amine.

Lubricating oils containing synthetic esters as oil base stocks are well-known in the art. In fact, due to the unique physical characteristics of these materials, the synthetic ester lubricating oils have been widely used in those areas where the oils are subjected to extreme temperature variations such as in aircraft engines and the like. These ester base oils do not, however, inherently exhibit high load carrying ability and cannot be used, without modification, where a high degree of lubricity is required. Also, the synthetic ester oil compositions are subject to oxidative degradation and cannot be used, without further modification, for long periods of time under oxidizing conditions. It is known that this degradation is primarily due to oxidation, heat and hydrolysis of the ester base oil.

Hydrocarbyl phosphate esters are well-known metal passivators, load carrying and extreme pressure additives for lubricant compositions. Among the different phosphate esters employed in this manner are a number of triaryl, trialkaryl and trialkyl phosphates with tricresyl phosphate being particularly preferred and used in many formulations.

Disclosures of phosphate esters of this type in lubricant compositions can be found in U.S. Pat. Nos. 3,468,802; 3,780,145; 3,914,023; 4,064,059; 4,087,386; 4,141,845 and 4,179,386. Many of these patents further disclose the use of amines and particularly aryl amines as antioxidants for different lubricant compositions. Amine type additives have also been disclosed as storage and hydrolytic stabilizers in lubricants as noted, for example, in WADC Technical Report 59-379, January, 1959 entitled "Improvement of the Storage Life of MIL-L-7808 Oils" where the use of aliphatic amines such as 2,6-di-tert-butyl-α-dimethylamino-p-cresol is shown. Also, U.S. Pat. No. 3,914,179 discloses the use of aliphatic and aliphatic/aromatic amines of a selected type with 2,6-ditertiarybutyl-4-dimethylaminomethyl phenol (same as cresol compound above) being preferred.

While many phosphate esters, as described above, and particularly tricresyl phosphate have been used as additives for lubricants such as synthetic lubricating oils, problems of hydrolytic degradation have sometimes developed when using certain phosphates. Such a problem could exist when using tertiary-butylphenyl substituted phosphates in selected synthetic ester lubricating oils. Other additives including amines have been used in lubricant compositions, as noted above; however, many of such additives are not helpful in inhibiting hydrolysis while even some of such additives which do provide hydrolytic stability for certain compositions are not particularly suitable for high temperature applications because of properties such as high volatility. Accordingly, the need still exists for providing a synthetic ester lubricant composition which is hydrolytically stable and has desirable properties such as load carrying ability and lubricity and additionally is particularly useful in high temperature applications such as involved in the operation of aircraft engines.

SUMMARY OF THE INVENTION

Now it has been found that selected synthetic ester lubricating oil compositions have particularly suitable high temperature properties while overcoming the problems of oxidative degradation and hydrolysis when the additive combination of this invention as defined herein is included in the composition. More particularly, this invention is directed to a synthetic ester lubricating oil composition having effective high temperature properties and hydrolytic stability comprising the additive combination of a selected tertiary-butylphenyl substituted phosphate and a selected alkyl amine.

This invention further involves a method for providing hydrolytically stable turbine oils which comprises adding a combination of a selected tertiary-butylphenyl phosphate and a selected alkyl amine to a synthetic ester base oil.

This invention is directed to a synthetic ester lubricating oil composition comprising a major amount of synthetic ester base oil, from about 0.1 to about 5% by weight, based on the weight of lubricating oil compositions, of a phosphate ester having the formula:

$$(RO)_3PO$$

with each R being phenyl or t-butylphenyl providing at least one R group is t-butylphenyl, and from about 0.001 to about 0.1% by weight, based on the weight of lubricating oil composition, of an alkyl amine having the formula:

$$NR_1R_2R_3$$

where each of $R_1$, $R_2$ and $R_3$ is a long chain alkyl group of about 16 to about 36 carbons or hydrogen provided at least one of $R_1$, $R_2$ and $R_3$ is said alkyl group, and the total number of carbon atoms is about 24 to about 60, said synthetic ester base oil being selected from the group consisting of:

(a) simple esters derived from monohydric aliphatic alcohols having from about 1 to about 18 carbon atoms and monobasic aliphatic acids having from about 2 to about 22 carbon atoms;

(b) complex esters formed from the reaction of three or more of the following compounds:

(i) monohydric aliphatic alcohols having about 1 to about 18 carbon atoms;

(ii) monobasic aliphatic acids having about 2 to about 22 carbon atoms;

(iii) aliphatic glycols or polyglycols having about 2 to about 70 carbon atoms;

(iv) polyhydric aliphatic alcohols having about 4 to about 25 carbon atoms;

(v) dibasic aliphatic acids having about 2 to about 25 carbon atoms;

(vi) polybasic aliphatic acids having about 3 to about 30 carbon atoms, wherein at least one polyfunctional alcohol and at least one polyfunctional acid are employed; and (c) polyolesters derived from polyhydric aliphatic alcohols containing from about 2 to about 10 hydroxyl groups and about 4 to about 25 carbon atoms and monobasic aliphatic acids having from about 2 to about 22 carbon atoms.

DETAILED DESCRIPTION OF THE INVENTION

This invention is directed to a synthetic ester lubricating oil composition having effective high temperature properties and hydrolytic stability making it particularly useful in extreme temperature conditions found in aircraft engines. The composition comprises a major amount of selected synthetic ester base oil and an effective additive combination of a selected tertiarybutylphenyl substituted phosphate and a selected alkyl amine.

The substituted phosphate material used in the additive combination of this invention has the following formula:

$$(RO)_3PO$$

with each R being phenyl or t-butylphenyl providing at least one R group is t-butylphenyl. The particularly preferred phosphate compound is diphenyl tert.-butylphenyl phosphate.

The alkyl amine compound used in this invention has the following formula:

$$NR_1R_2R_3$$

with each R being a long chain alkyl group of about 16 to about 36 carbon atoms or hydrogen providing at least one R is said alkyl group and the total number of carbon atoms in said amine is from about 24 to about 60. Preferably each alkyl group will contain about 16 to about 24 carbon atoms and the total number of carbon atoms in said amine is about 32 to about 40. The preferred amine is a dialkyl or secondary amine.

The synthetic ester base oils used in this invention are particularly useful as lubricants for aircraft engines. Such ester base oils include simple esters, complex esters and polyolesters and are further defined as follows:

As used herein, the term "simple ester" shall mean or include esters derived from monohydric aliphatic alcohols and monobasic aliphatic carboxylic acids, and esters derived from monohydric aliphatic alcohols and dibasic aliphatic acids. Generally, the monohydric alcohols used to prepare these esters will have from about 1 to about 18 carbon atoms in the molecule, and preferably from about 4 to about 13 carbon atoms while the monobasic aliphatic acids will have from about 2 to about 22 carbon atoms in the molecule, and preferably about 4 to about 12 carbon atoms. The dibasic acids, on the other hand, will generally have from about 2 to about 25 carbon atoms in the molecule, and preferably about 4 to about 14 carbon atoms. As is well-known in the art, both the acid portion and the alcohol portion of the ester may be either straight or branched chained. More commonly, however, a straight chain aliphatic carboxylic acid will be used in combination with branched chain aliphatic alcohols.

The term "complex esters," as used herein shall mean an ester formed from the reaction of three or more of the following compounds:

1. Monohydric aliphatic alcohols
2. Monobasic aliphatic acids
3. Aliphatic glycols or polyglycols
4. Polyhydric aliphatic alcohols
5. Dibasic aliphatic acids
6. Polybasic aliphatic acids where at least one polyfunctional alcohol and at least one polyfunctional acid are employed. This definition includes esters of the following types:

I. Glycol centered complex esters; i.e., esters having a chain exemplified as monohydric alcohol-dibasic acid-(glycol-dibasic acid)$_x$-monohydric alcohol;

II. Dibasic acid centered complex esters; i.e., esters having a chain structure which may be exemplified as monobasic acid-glycol-(dibasic acid-glycol)$_x$-monobasic acid; and III. Alcohol acid terminated complex esters; i.e., esters having a chain structure which may be exemplified as monobasic acid-(glycol-dibasic acid)$_x$-monohydric alcohol; wherein x is a number greater than 0, preferably about 1 to about 6.

Preparation of complex esters is disclosed in U.S. Pat. Nos. 2,575,195, 2,575,196, and 3,016,353. Generally, the monohydric aliphatic alcohols used in the preparation of these esters will have from about 1 to about 18, and preferably about 4 to about 13 carbon atoms in the molecule and the same may have a straight or branched chain structure. The polyhydric aliphatic alcohols which may be used to prepare esters of this type generally will have from about 4 to about 25 and preferably about 5 to about 20 carbon atoms per molecule and the same may contain ether linkages. The aliphatic glycols or polyglycols may contain from about 2 to about 70 and preferably from about 2 to about 18 carbon atoms per molecule and also may contain ether linkages. The alcohol should, however, be free of all atoms other than carbon, hydrogen and oxygen. Monobasic aliphatic acids which may be used to prepare these esters will generally contain from about 2 to about 22, and preferably from about 4 to about 12 carbon atoms and these materials may have either straight or branched chain structures. The dibasic acids which may be used in the preparation of the complex esters will have from about 2 to about 25, and preferably about 4 to about 14 carbon atoms in the molecule. The polybasic aliphatic acids will contain from about 3 to about 30, and preferably about 4 to about 14 carbon atoms in the molecule.

As used herein, the term "polyolester" shall mean a fully esterified ester, or at least a substantially fully esterified ester, obtained when a polyhydric aliphatic alcohol having at least 2 hydroxyl groups is used. Generally, these alcohols will contain from about 2 to about 10 hydroxyl groups per molecule and from about 4 to about 25, and preferably about 5 to about 20 carbon atoms therein. The polyolesters include esters derived from the hindered neopentyl alcohols such as neopentylglycol, trimethylolethane, trimethylolpropane, higher trimethylolalkanes, pentaerythritol, dipentaerythritol, tripentaerythritol and higher pentaerythritol or other ethers. Esters prepared with these hindered alcohols are preferred as the base oil used in the lubricating oil compositions of the present invention since they will withstand higher temperatures than the aforedescribed simple and complex esters and since these esters already have a relatively long storage stability. Generally, the polyhydric aliphatic alcohols will be esterified with a normal or branched chain monobasic aliphatic acid having from about 2 to about 22, and preferably from about 4 to about 12 carbon atoms in the molecule or with mixtures of such acids. Particularly preferred polyolesters are those made of esterifying a polyol having at least 3 hydroxyl groups with a monocarboxylic alkanoic acid having about 5 to about 10 carbon atoms and this includes esters made from polyols chosen from the groups consisting of trihydroxy polyols, tetrahydroxy polyols and ethers formed by combining two or more of said polyols. Esters of this type as well as of other types useful in the composition of this invention are described throughout the literature and in such U.S. Patents as numbers: 2,015,088; 2,723,286; 2,743,243; 2,575,196; 3,218,256; and 3,360,465. Moreover, polyolesters of the type useful in the synthetic lubricating oil compositions of this invention are available commercially.

In general, the ester lubricating oil base stocks used in the composition of this invention will have: viscosity indices of at least 100, pour points not exceeding −40° F., boiling and/or decomposition temperatures not less than 600° F., and flash points not less than 400° F. It will, of course, be appreciated that mixtures of any of the aforedescribed esters could be used in the compositions of this invention and as is pointed out more fully hereinafter, a particularly preferred blend is obtained by mixing esters of trimethylolpropane and polypentaerythritol. Moreover, blends of one or more of the aforedescribed esters could be used in combination with natural or synthetic mineral oil bases to provide lubricating oil base stocks which may be used in present invention. In this regard, it will be appreciated that individual esters having viscosity indices below 100 and/or pour points above −40° F., can be used in such blends provided that the mixture itself has the desired properties.

In a preferred embodiment of this invention, the ester base oil will comprise from about 50 to 75 wt. % of a substantially neutral ester of trimethylolpropane and from about 25 to 50 wt. % of a substantially neutral ester of polypentaerythritol. The ester base used in the preferred embodiment will be prepared by esterifying the trimethylolpropane with at least one aliphatic monocarboxylic acid having from about 7 to about 10 carbon atoms in the molecule and most preferably with a blend comprising at least two such monocarboxylic acids. The polypentaerythritol, on the other hand, will be esterified with at least two aliphatic monocarboxylic acids having from about 5 to about 10 carbon atoms in the molecule and, most preferably, with a blend comprising at least three such monocarboxylic acids. In a most preferred embodiment, about two parts by weight of the trimethylolpropane ester will be used per part of the polypentaerythritol ester.

The amount of t-butylphenyl substituted phosphate ester used in the composition of the invention will be about 0.1 to about 5% by weight, based on the weight of lubricating oil composition and preferably from about 0.2 to about 4% by weight. The amount of alkyl amine that may be used will vary from about 0.001 to about 0.1% by weight, based on the weight of lubricating oil composition and preferably from about 0.002 to about 0.01% by weight.

Other lubricating additives typically incorporated in synthetic ester lubricating oils can be added to the lubricating compositions of the present invention, generally in amounts of about 0.01 to about 5.0 weight percent each, based on the total weight of the composition. Examples of such additives include, but are not limited to, viscosity index improvers, pour point depressants, corrosion inhibitors, thickeners, sludge dispersants, rust inhibitors, anti-emulsifying agents, anti-oxidants, dyes, dye stabilizers and the like.

The following example is set forth to illustrate the present invention and should not be construed as limitations thereof:

EXAMPLE I

An ester oil lubricating composition was prepared using 100 parts by weight of a base oil comprising a 70:30 weight ratio of esters derived from (a) trimethylolpropane and a mixture of aliphatic monocarboxylic acids having from 7 to 10 carbon atoms and (b) polypentaerythritol and a mixture of aliphatic monocarboxylic acids having 5 to 10 carbon atoms. The composition also contained 3% by weight of diphenyl tertiary-butylphenyl phosphate and 0.002% by weight of a secondary amine (di-$C_{18}$ alkyl amine) as well as the following additives: 0.1 wt. % of benzotriazole, 1.3 wt. % of dioctyl diphenylamine, 1.1 wt. % of α-phenylnaphthylamine, and 0.02 wt. % of sebacic acid.

Using the above prepared lubricating oil composition and preforming a hydrolytic stability test at 90° C. for 144 hours, the final acid number was 7.04. For comparison purposes, the same composition using the diphenyl tertiary-butylphenyl phosphate, but without the alkyl amine resulted in a final acid number of 24.64.

Another comparison using tricresyl phosphate instead of the diphenyl tertiary-butylphenyl phosphate and also without the alkyl amine but otherwise for the same lubricating composition resulted in a final acid number of 8.68.

The above results point out that while some phosphate materials such as tricresyl phosphate provide adequate properties for synthetic ester lubricating oils, other substituted phosphates and particularly the tertiary butylphenyl substituted phosphates, do not provide suitable properties when used alone. However, as further shown when using the tertiary butylphenyl substituted phosphates in combination with an alkyl amine compound as defined by this invention, suitable hydrolytic stability properties are unexpectedly found.

What is claimed is:

1. A synthetic ester lubricating oil composition comprising a major amount of synthetic ester base oil, from about 0.1 to about 5% by weight, based on the weight of lubricating oil composition of a phosphate ester having the formula:

$$(RO)_3PO$$

with each R being phenyl or t-butylphenyl provided at least one R group is t-butylphenyl, and from about 0.001 to about 0.1% by weight, based on the weight of lubricating oil composition, of an alkyl amine having the formula:

$$NR_1R_2R_3$$

where each of $R_1$, $R_2$ and $R_3$ is a long chain alkyl group of about 16 to about 36 carbon atoms or hydrogen provided at least one of $R_1$, $R_2$ and $R_3$ is said alkyl group and the total number of carbon atoms is about 24 to about 60, said synthetic ester base oil being selected from the group consisting of:

(a) simple esters derived from monohydric aliphatic alcohols having from about 1 to about 18 carbon atoms and monobasic aliphatic acids having from about 2 to about 22 carbon atoms;

(b) complex esters formed from the reaction of three or more of the following compounds:
(i) monohydric aliphatic alcohols having about 1 to about 18 carbon atoms;
(ii) monobasic aliphatic acids having about 2 to about 22 carbon atoms;
(iii) aliphatic glycols or polyglycols having about 2 to about 70 carbon atoms;
(iv) polyhydric aliphatic alcohols having about 4 to about 25 carbon atoms;
(v) dibasic aliphatic acids having about 2 to about 25 carbon atoms;
(vi) polybasic aliphatic acids having about 3 to about 30 carbon atoms, wherein at least one polyfunctional alcohol and at least one polyfunctional acid are employed; and
(c) polyolesters derived from polyhydric aliphatic alcohols containing from about 2 to about 10 hydroxyl groups and about 4 to about 25 carbon atoms and monobasic aliphatic acids having from about 2 to about 22 carbon atoms.

2. The composition of claim 1 wherein said phosphate ester is diphenyl t-butylphenyl phosphate.

3. The composition of claim 2 wherein said alkyl amine is a dialkyl amine, each alkyl group containing about 16 to about 24 carbon atoms.

4. The composition of claim 3 wherein from about 0.2 to about 4% by weight, based on the weight of lubricating oil composition, of said phosphate ester and from about 0.002 to about 0.01% by weight, based on the weight of lubricating oil composition, of said alkyl amine are used.

5. The composition of claim 1 wherein said synthetic ester base oil comprises from about 50 to about 75 wt. % of an ester of trimethylolpropane and an aliphatic monocarboxylic acid having from about 7 to about 10 carbon atoms and from about 25 to about 50 wt. % of an ester of polypentaerythritol and an aliphatic monocarboxylic acid having from about 5 to about 10 carbon atoms.

6. The composition of claim 5 wherein said phosphate ester is diphenyl t-butylphenol phosphate and said alkyl amine is a dialkyl amine, each alkyl group containing about 16 to about 24 carbon atoms.

7. The composition of claim 6 further comprising from about 0.01 to about 5.0 weight percent each of benzotriazole, dioctyl diphenylamine, α-phenylnaphthylamine and sebacic acid.

8. The composition of claim 7 wherein from about 0.2 to about 4% by weight, based on the weight of lubricating oil composition, of said phosphate ester and from about 0.002 to about 0.1% by weight, based on the weight of lubricating oil composition, of said alkyl amine are used.

9. The method of providing a hydrolytically stable synthetic ester lubricating oil composition comprising adding to a major amount of a synthetic ester base oil from about 0.1 to about 5% by weight, based on the weight of lubricating oil composition, of a phosphate ester having the formula:

$$(RO)_3PO$$

with each R being phenyl or t-butylphenyl provided at least one R group is t-butylphenyl, and from about 0.001 to about 0.1% by weight, based on the weight of lubricating oil composition, of an alkyl amine having the formula:

$$NR_1R_2R_3$$

each of $R_1$, $R_2$ and $R_3$ is a long chain alkyl group of about 16 to about 36 carbon atoms or hydrogen, provided each of $R_1$, $R_2$ and $R_3$ is said alkyl group and the total number of carbon atoms is about 24 to about 60.

10. The method of claim 9 wherein said phosphate ester is diphenyl t-butylphenyl phosphate and said alkyl amine is a dialkyl amine, each alkyl group containing about 16 to about 24 carbon atoms.

11. The method of claim 10 wherein from about 0.2 to about 4% by weight, based on the weight of lubricating oil composition, of said phosphate ester and from about 0.002 to about 0.01% by weight, based on the weight of lubricating oil composition, of said alkyl amine are used and said synthetic ester base oil is selected from the group consisting of:
(a) simple esters derived from monohydric aliphatic alcohols having from about 1 to about 18 carbon atoms and monobasic aliphatic acids having from about 2 to about 22 carbon atoms;
(b) complex esters formed from the reaction of three or more of the following compounds:
(i) monohydric aliphatic alcohols having about 1 to about 18 carbon atoms;
(ii) monobasic aliphatic acids having about 2 to about 22 carbon atoms;
(iii) aliphatic glycols or polyglycols having about 2 to about 70 carbon atoms;
(iv) polyhydric aliphatic alcohols having about 4 to about 25 carbon atoms;
(v) dibasic aliphatic acids having about 2 to about 25 carbon atoms;
(vi) polybasic aliphatic acids having about 3 to about 30 carbon atoms,
wherein at least one polyfunctional alcohol and at least one polyfunctional acid are employed; and
(c) polyolesters derived from polyhydric aliphatic alcohols containing from about 2 to about 10 hydroxyl groups and about 4 to about 25 carbon atoms and monobasic aliphatic acids having from about 2 to about 22 carbon atoms.

12. The method of claim 11 wherein said synthetic ester base oil comprises from about 50 to about 75 wt.% of an ester of trimethylolpropane and an aliphatic monocarboxylic acid having from about 7 to about 10 carbon atoms and from about 25 to about 50 wt.% of an ester of polypentaerythritol and an aliphatic monocarboxylic acid having from about 5 to about 10 carbon atoms and said lubricating oil composition further comprising from about 0.01 to about 5.0 weight percent each of benzotriazole, dioctyl diphenylamine, α-phenylnaphthylamine and sebacic acid.

* * * * *